United States Patent [19]

Sweeney

[11] 4,302,214

[45] Nov. 24, 1981

[54] MOTOR FUEL COMPOSITION

[75] Inventor: W. Alan Sweeney, Larkspur, Calif.

[73] Assignee: Chevron Research Company, San Francisco, Calif.

[21] Appl. No.: 155,044

[22] Filed: May 30, 1980

[51] Int. Cl.[3] ..... C10L 1/18
[52] U.S. Cl. ..... 44/56
[58] Field of Search ..... 44/56, 77

[56] References Cited

U.S. PATENT DOCUMENTS 3,869,262 3/1975 Mayerhoffer et al. ..... 44/70

*Primary Examiner*—Winston A. Douglas
*Assistant Examiner*—Y. Harris-Smith
*Attorney, Agent, or Firm*—D. A. Newell; J. J. DeYoung

[57] ABSTRACT

Disclosed is a motor fuel comprising a major portion of gasoline-boiling-range compounds and from 0.1 to 49 volume percent di-(t-pentoxy)methane.

6 Claims, No Drawings

MOTOR FUEL COMPOSITION

BACKGROUND OF THE INVENTION

The present invention relates to a motor fuel composition comprising gasoline-boiling-range compounds and di-(t-pentoxy)methane.

The use of oxygen-containing compounds in gasoline is known in the art. See, for example, U.S. Pat. Nos. 3,901,664; 3,988,122 and 3,869,262.

U.S. Pat. No. 3,869,262 discloses gasoline compositions preferably containing at least three oxygen-containing compounds. Claimed are gasoline compositions containing diether compounds of the general formula:

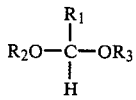

wherein $R_1$ is H or $CH_3$ and $R_2$ and $R_3$ are each $CH_3$, $C_2H_5$, $C_3H_7$ or $C_4H_9$. Preferred are the lower molecular weight compounds which contain one or more methyl groups. The largest formal exemplified is diethylformal containing only 5 carbon atoms.

U.S. Pat. Nos. 3,594,136; 3,270,497 and 2,184,956 all disclose glycol ethers, such as the di-t-butyl ether of ethylene glycol, as blending agents for hydrocarbon fuels.

SUMMARY OF THE INVENTION

A motor fuel comprising a major portion of gasoline boiling-range compounds and from 0.1 to 49 volume percent di-(t-pentoxy)methane.

DETAILED DESCRIPTION OF THE INVENTION

The invention resides in a motor fuel comprising a major portion of gasoline-boiling-range compounds and 0.1 to 49 volume percent di-(t-pentoxy)methane. The fuel will generally comprise 51 to 99.9 volume percent gasoline-boiling-range compounds (other than di-(t-pentoxy)methane) and 0.1 to 49 volume percent di-(t-pentoxy)methane. Preferably, the fuel will comprise 70 to 99.8 volume percent gasoline boiling range compounds and 0.2 to 30 volume percent di-(t-pentoxy)methane. Still more preferably, the fuel will comprise 90 to 99.8 volume percent gasoline-boiling-range compounds and 0.2 to 10 volume percent di-(t-pentoxy)methane.

Gasoline-boiling-range compounds suitable for use in motor fuels are well known in the art and usually boil between about the boiling point of butane and 430° F. Generally, these compounds will comprise hydrocarbons derived from refined crude oil. However, oxygenated compounds can also be used, such as methanol, ethanol, methyl-t-butyl ether, etc.

Methods of making di-(t-pentoxy)methane are known in the art. One method of making di-(t-pentoxy)methane is from the reaction of t-amyl alcohol and formaldehyde in the presence of an acid catalyst such as p-toluene sulfonic acid.

A motor fuel consisting of 92 volume percent of a lead-free standard gasoline having a research octane number of 95.1 and a motor octane number of 85.9 and 8 volume percent of various diethers were tested under standard test conditions (ASTM D-2699 and D-2700) to determine their research and motor octane numbers. The blending octane number (ON) is calculated as follows:

$$\text{Blending } ON = \frac{100(\text{measured } ON \text{ of blend} = ON \text{ of base fuel})}{\text{percent substance in blend}} + ON \text{ of base fuel}$$

The fuels were also tested for corrosion potential using ASTM D-665 (using 5 hours and tap water). The results are shown in Table I below.

TABLE I

| Ether Additive | Blending Research Octane No. | Blending Motor Octane No. | Percent Rust |
|---|---|---|---|
| None (base fuel) | 95.1 | 85.9 | <5 |
| di-sec-butoxymethane | 70 | 78 | 35 |
| di-iso-butoxymethane | 54 | 61 | 20 |
| di-isopropoxymethane | 86 | 77 | 50 |
| di-n-butoxymethane | 5 | 11 | 100 |
| di-ethoxymethane | 59 | 52 | 90 |
| di-(t-pentoxy)methane | 110 | 91 | 10 |

The above octane data indicates that di-(t-pentoxy)methane produces unexpectedly high blending research and motor octane numbers. This is particularly surprising in view of the fact that all of the other ether compounds tested decrease the octane number from the value of the base fuel. It is also surprising in view of the teaching of U.S. Pat. No. 3,869,262 which teaches that the lower molecular weight diethers are preferred.

The above rust data further indicates that di-(t-pentoxy)methane is unexpectedly superior to the other formal compounds in not promoting corrosion.

What is claimed is:

1. A gasoline motor fuel comprising a major portion of gasoline-boiling-range compounds and from 0.1 to 49 volume percent di-(t-pentoxy)methane.

2. The motor fuel of claim 1 wherein 0.2 to 10 volume percent is di-(t-pentoxy)methane.

3. The motor fuel of claim 1 wherein 51 to 99.9 volume percent of said fuel comprises gasoline-boiling-range compounds.

4. The motor fuel of claim 1 wherein 51 to 99.9 volume percent of said compounds comprise gasoline-boiling-range hydrocarbons.

5. The motor fuel of claim 1 wherein 70 to 99.8 volume percent of said compounds comprise gasoline-boiling-range hydrocarbons and 0.2 to 30 volume percent is di-(t-pentoxy)-methane.

6. The motor fuel of claim 1 wherein 90 to 99.8 volume percent of said compounds comprise gasoline-boiling-range hydrocarbons and 0.2 to 10 volume percent is di-(t-pentoxy)methane.

* * * * *